United States Patent [19]

Chen

[11] Patent Number: 4,932,638

[45] Date of Patent: Jun. 12, 1990

[54] STEPPING TYPE EXPANSION BOLT EXTRACTING GUN

[76] Inventor: Tsun-Ping Chen, No. 313-1 Chang Yuan Rd., Huatan Changhua, Taiwan

[21] Appl. No.: 264,878

[22] Filed: Oct. 31, 1988

[51] Int. Cl.[5] ..... B25B 1/00

[52] U.S. Cl. ..... 269/6; 29/282; 29/267; 254/21; 254/18

[58] Field of Search ..... 254/21, 18; 269/6; 29/267, 268, 278, 280, 282, 283, 283.5

[56] References Cited

U.S. PATENT DOCUMENTS 3,096,975 7/1963 Irwin ..... 269/236
4,311,069 1/1982 Walker ..... 254/18
4,627,420 12/1986 Katz ..... 269/6

FOREIGN PATENT DOCUMENTS 2903252 9/1980 Fed. Rep. of Germany ..... 29/282

*Primary Examiner*—Frederick R. Schmidt
*Assistant Examiner*—David A. Holmes
*Attorney, Agent, or Firm*—Birch, Stewart, Kolasch & Birch

[57] ABSTRACT

A stepping type expansion bolt extracting gun, making use of a shifting mechanism to shift a gun barrel by means of a stepping operation, and an arresting and releasing mechanism to prevent the gun barrel from returning. A check plate is provided to control the gun barrel to shift back to the original position. By means of said arrangement, the present invention is applicable to extract the live spindle of an expansion bolt in a labor-saving and most efficient way to replace the linking rod type actuation of the prior art.

3 Claims, 6 Drawing Sheets

STEPPING TYPE EXPANSION BOLT EXTRACTING GUN

BACKGROUND OF THE INVENTION

The present invention is related to a stepping type expansion bolt extracting gun and, more particularly to a labor-saving extracting gun which comprises a gun barrel shifting mechanism and an arresting and releasing mechanism.

An expansion bolt is used to be punched in a pre-drilled hole on a wall to provide a support for hanging or fixation of an article. In contrary to regular iron or steel nails, one must drill a hole in advance for an expansion bolt to insert the bolt therein. When an expansion bolt is punched or inserted into the pre-drilled hole, the live spindle of the expansion is extracted to let the middle portion of the expansion bolt protrude outward inside the hole. By means of the live spindle extracting process, the expansion bolt is firmly secured to the wall. Regularly, there are two kinds of expansion bolts available in the market. One is a "push-in type" expansion bolt of which the live spindle must be punched in the pre-drilled hole by a hammer or other suitable tools to force the middle portion of the expansion bolt to protrude outward. The other is an "extracting type" expansion bolt of which the live spindle must be extracted by an extracting tool or the so called expansion bolt extracting gun, to let the live spindle of the expansion bolt be extracted outward so as to further let the middle portion of the bolt protrude outward. The present invention is an improvement in the convention expansion bolt extracting gun.

The expansion bolt extracting gun of the prior art, as illustrated in FIGS. 1 and 2 is similar to a pliers or a shearing tool. The gun is mainly comprised of a fixed handle (1) and a movable handle (2) with a bolt provided to fix both fixed and movable handles together. A movable hollow rod (3) is pivotally connected with the movable handle (2) at the top by means of a bolt (102). A bushing (5) is fixedly attached to the fixed handle (1) at the upper end for the front end of the said movable hollow rod (3). The bushing (5) is arranged to provide a cutting at the front (501) such that the protruding portion (61) of expansion bolt (6) is stopped at the cutting (501) when in operation to extract the live spindle (62). The movable hollow rod (3) is also arranged to provide as cutting (301) at the front to retain the head (63) of the live spindle (62) thereinside. When the movable handle (2) is forced to move toward the fixed handle (1), the live spindle (62) is driven by the movable hollow rod (3) to move outward, so as to let the central expansion portion (64) of the expansion bolt (6) protrude outwardly and to let the expansion bolt be firmly fixed in the hole (as shown in FIG. 2). The structure of the prior art, as above described, is indeed very simple. While in operation, the movable handle (2) is shifted forward to drive the movable hollow rod (3) to move backward. Since the movable handle is connected with the fixed handle by means of a single bolt (101), the shifting of the movable hollow rod (3) is not very stable, and the friction force of the movable hollow rod (3) against the bushing (5) is increased. Further, in the prior art there is no releasing mechanism provided. Therefore, a strong force must be applied at certain times, to drive the movable handle to move toward in the fixed handle.

In view of the inconveniences and drawbacks, a stepping type and labor-saving expansion bolt extracting gun is thus created to provide for better performance.

SUMMARY OF THE INVENTION

The main object of the present invention is to provide a stepping type expansion bolt extracting gun wherein the gun barrel is controlled by a shifting mechanism and an arresting and releasing mechanism to stably move forward and backward through a labor-saving operation, so as to keep the punched expansion bolt at the right position.

A yet further object of the present invention is to provide a stepping type expansion bolt extracting gun wherein the shifting plate, the check plate and the trip plate are respectively connected with a spring at the back side thereof to provide a spring force to permit the members to be forced to return to an original position when triggering force is released.

In general, the present invention is to provide a stepping type expansion bolt extracting gun which includes a gun holder, including a sliding seat, first slot, second slot, and third slot respectively arranged from the front, and a fixed handle extended downward from the rear end of the gun holder. The sliding seat includes a notch at the front. A partition is arranged between the first slot and the second slot. Another partition is arranged between the second slot and the third slot. The two partitions and the back side surrounding wall of the gun holder are arranged to provide a respective circular hole to aim at one another.

A cylindrical gun barrel is provided to slide through the circular holes of the partitions and the back side surrounding wall.

A shifting mechanism includes a movable handle, a shifting plate, a spring, and a locating pin. The movable handle includes a forked top end fixed in the third slot by a pivotal joint with the lower end flexibly arranged to move toward the fixed handle. The shifting plate is arranged to provide a flat plate-shaped configuration and is positioned in the third slot with the lower portion being in contact with the movable handle and includes a circular hole at the center for penetration of the gun barrel therethrough. At the time the movable handle is forced to move toward the fixed handle, the lower portion of the shifting plate is forced to incline so as to let the rhombic angle of the front upper edge and the rear lower edge of the circular hole of the shifting plate engage the gun barrel to move backward. The spring is mounted on the gun barrel by a slip joint, and is arranged in the third slot between the shifting plate and the back side surrounding wall to provide the shifting plate with a forward push and to let the movable handle return to the original position. The locating pin is positioned in the third slot of the gun holder to prohibit the upper portion of the shifting plate from moving forward and to permit the shifting plate to be arranged at a vertical position against the gun barrel when it is released from the control of the movable handle, so as to permit the gun barrel to freely slide through the circular hole of the shifting plate.

An arresting and releasing mechanism includes a check plate, a spring, and a locating pin. The check plate is allocated in the second slot and arranged to have a prolonged configuration comprising a circular hole for penetration of the gun barrel therethrough, with the lower portion of the check plate extending downwardly to protrude beyond the gun holder and to a position at the front side of the movable handle. The spring is mounted on the gun barrel and is positioned in the second slot at the back side of the check plate to provide the check plate with a forward push. The locating pin is transversely allocated in the second slot and arranged at the front of the check plate to permit the check plate to be forced to incline outward, by means of the engagement of the rhombic angle of the front lower edge and the rear upper edge of the circular hole with the gun barrel. The gun barrel is restrained from moving ahead, at the time to release the gun barrell and to permit the gun barrel be moved forward. The lower end of the check plate is pulled backward to the released position to permit the check plate to be in a vertical position against the gun barrel and the gun barrel is released to slide through the circular hole of the check plate.

A trip plate is arranged to slide in the sliding seat comprising a notch at the front for the head of the live spindle of the expansion bolt to hang thereup and to be retained thereabout. The rear end of the trip plate is fixedly attached to the front end of the gun barrel to follow the gun barrel to slide in the sliding seat.

A return spring is mounted on the gun barrel and positioned in the first slot between the trip plate and the partition to provide the trip plate and the connected gun barrel with a forwarding force at the time the check plate is moved to the releasing position.

A stop block is fixedly arranged at the front of the sliding seat and includes a notch at the front to stop the rear end protruding portion of the expansion bolt.

The component parts are utilized to form an expansion bolt extracting gun including the shifting mechanism to extract the live spindle of the expansion bolt through a stepping operation, and by means of the arresting and releasing mechanism to let the gun barrel and the trip plate automatically return to the original position.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENT

Figure 3:
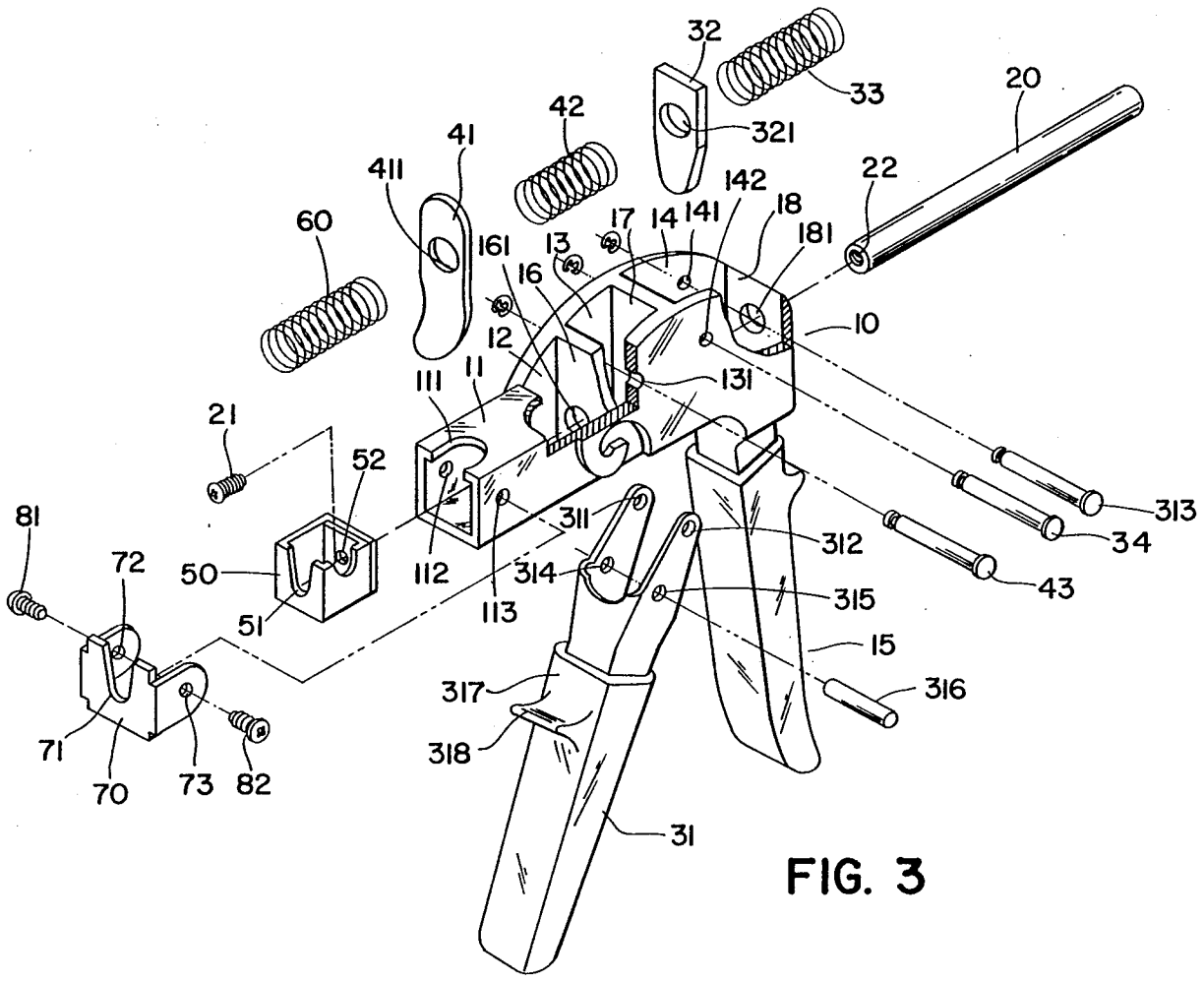
FIG. 3 is a perspective fragmentary view of an expansion bolt extracting gun embodying the present invention.
Figure 4:
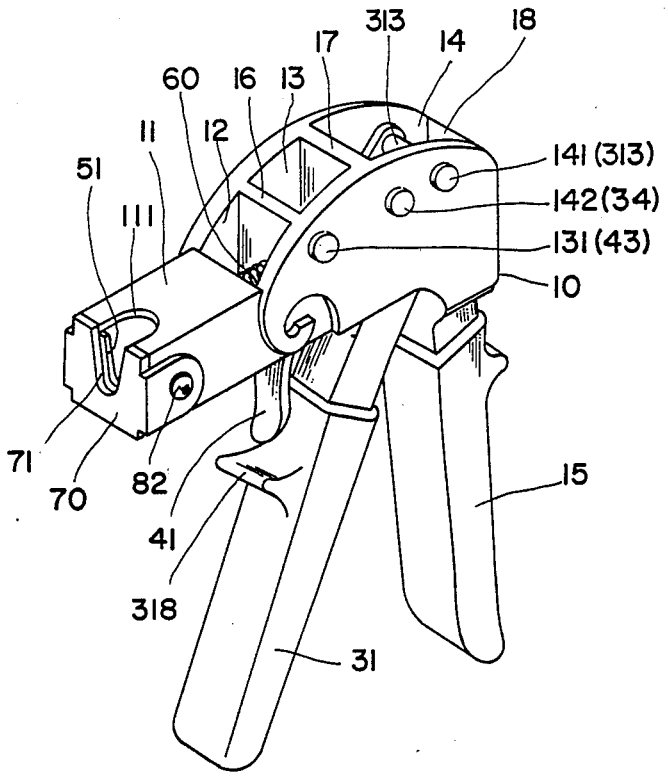
FIG. 4 is a perspective assembly view of the preferred embodiment according to the present invention.

Referring to FIGS. 3 and 4, an expansion bolt extracting gun according to the present invention includes: a gun holder (10), a gun barrel (20), a shifting mechanism composed of movable handle (31), a shifting plate (32), a spring (33) and a locating pin (34). In addition, an arresting and releasing mechanism is composed of a check plate (41), a spring (45), a locating pin (43), a trip plate (50), a return spring (60), and a stop block (70).

The gun holder (10) includes a sliding seat (11), a first slot (12), a second slot (13), and a third slot (14), respectively arranged from the front. A fixed handle (15) extends downwardly from the rear end of the gun holder (10). The sliding seat (11) is a square tube, comprising a notch (111) at the front, and two bolt holes (112) (113) at both sides. A partition (16) is arranged between the first slot and the second slot, a partition (17) is arranged between the second slot and the third slot. The partitions (16) and (17), and the surrounding wall (18) of the gun holder (10) are arranged to provide a respective circular hole (161) (171) (181) for the gun barrel (20) to penetrate therethrough.

The shifting mechanism includes a movable handle (31), a shifting plate (32), a spring (33), and a locating pin (34). The movable handle (31) has a forked top end provided with circular holes (311) (312). A fixing pin (313) is provided to insert through the circular hole (141) of the gun holder (10) and the circular holes (311) (312) of the movable handle (31) to permit the movable handle (31) to be fixed in the third slot by a pivotal joint. The movable handle (31) also includes circular holes (314) (315) at the top for a pin (316) to penetrate therethrough, a sleeve (317) at the lower portion for grasping by an individual's hand and the sleeve (317) is arranged to provide a protruding portion (318). The shifting plate (32) is arranged in the third slot (14) with the lower portion positioned at the back side of the pin (316) of the movable handle (31). The shifting plate (32) is a flat plate, having a circular hole (321) at the center for penetration of the gun barrel (20) therethrough. Moving the pin (316) pushes the lower portion of the shifting plate (32) to permit the shifting plate (32) to incline. The spring (33) is mounted on the gun barrel (20) by a slip joint, and is arranged in the third slot (14) between the shifting plate (32) and the surrounding wall (18), to provide the shifting plate (32) with a forward push. The locating pin (34) is inserted through the circular hole (142) of the third slot (14) of the gun holder (10) to prohibit the upper portion of the shifting plate (32) from moving forward, and to permit the shifting plate (32) to be arranged at a vertical position against the gun barrel (20) when it is released from the control of the movable handle (31), so as to let the gun barrel (20) slide through the circular hole (321).

Figure 5:
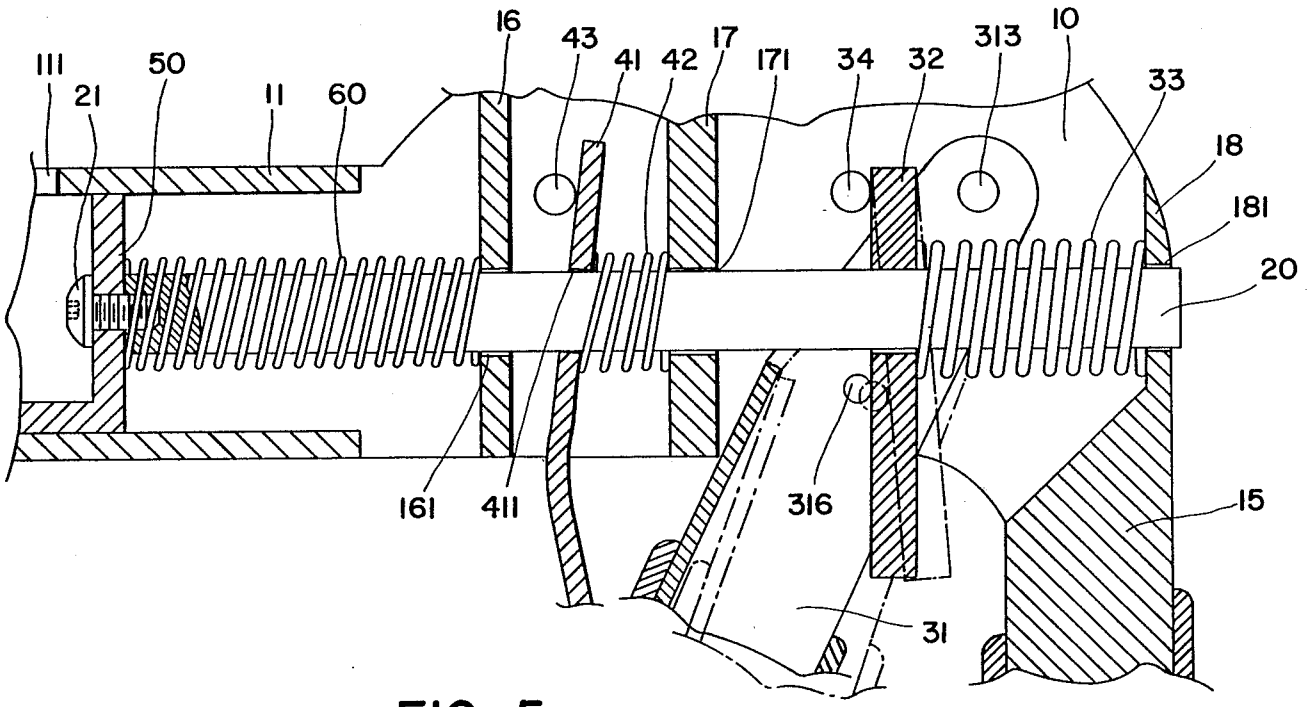
FIGS. 5–7 illustrates the operation of the preferred embodiment according to the present invention.
Figure 6:
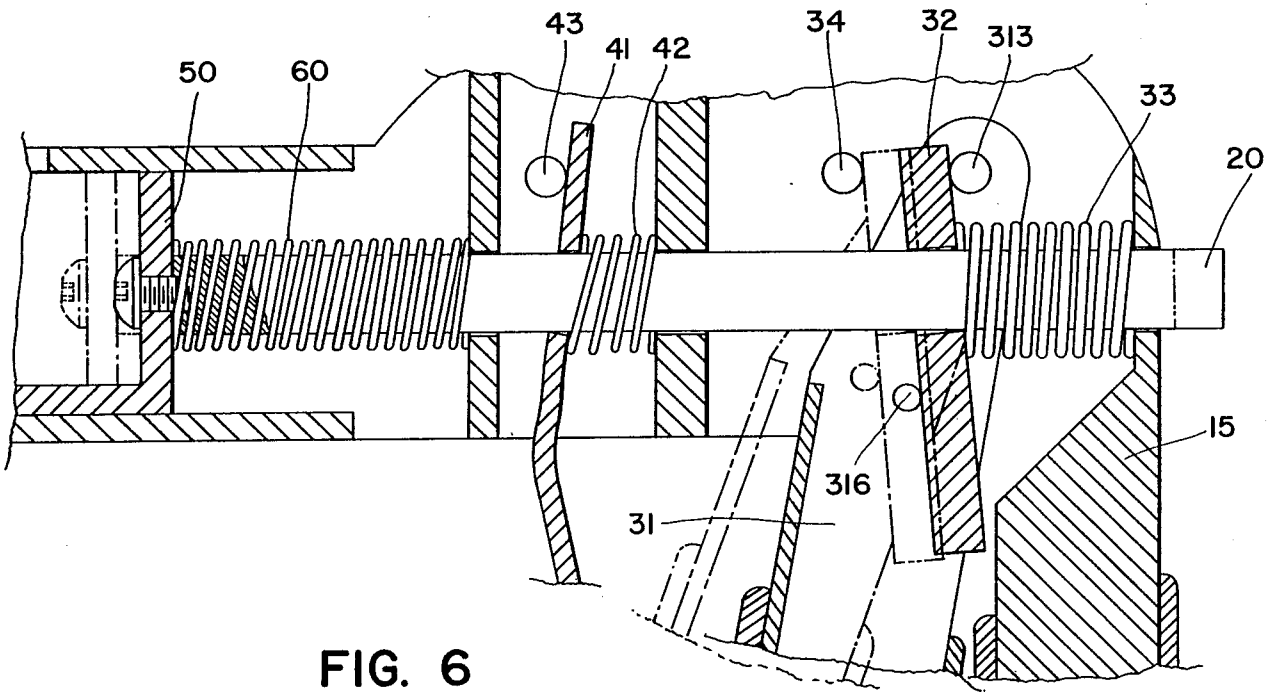

Please refer to the schematic drawings of FIGS. 4 and 5, regarding the motion of the shifting mechanism. When in stationary state with no outer force applied to the movable handle, the shifting plate (32) is pushed by the spring (33) and constrained by the locating pin (34) and the pin (316) to be in a vertical position against the gun barrel (20). When the operator holds over the movable handle (31) to pull it towards the fixed handle (15), the pin (316) of the movable handle pushes the lower portion of the shifting plate (32) to permit the spring (33) to force the shifting plate (32) to incline to a position as illustrated in the dotted line in FIG. 5, and the rhombic angle of the front upper edge and the rear lower edge of the circular hole (321) will engage the gun barrel (20). When the force is continuously applied, as shown in FIG. 6, the shifting plate (32) will return from the dotted line position to the full line position, and the gun barrel (20) will also be shifted from the dotted line position to the full line position. When the movable handle (31) is released, the shifting plate (32) and the movable handle (31) will be forced by the spring (32) to return to the full line position as illustrated in FIG. 5. By means of a continuous triggering operation, the gun barrel (20) will be shifted back to a preferred position.

Figure 7:
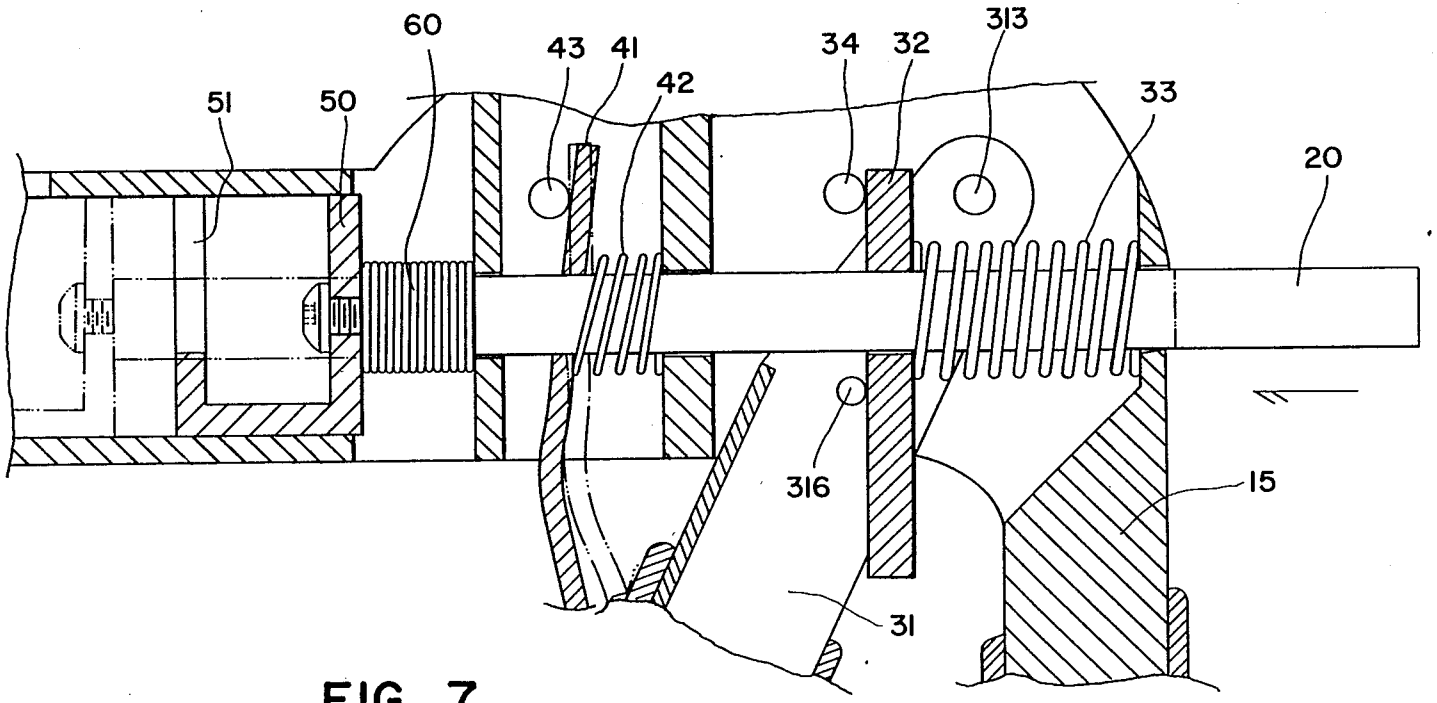

The arresting and releasing mechanism includes a check plate (41), a spring (42), and a locating pin (43). The check plate (41) is allocated in the second slot (13) and arranged to have a prolonged configuration comprises a circular hole (411) for penetration of the gun barrel (20) therethrough. The lower portion of the check plate (41) extends downward to protrude beyond the gun holder (10) and to a position at the front side of the movable handle (31) (referring to FIG. 4). The spring (42) is mounted on the gun barrel (20) and positioned in the second slot (13) between the check plate (41) and the partition (17) to provide the check plate (41) with a forward push. The locating pin (43) penetrates through the circular hole (131) of the second slot (13) and is arranged at the front of the check plate (41) to permit the check plate (41) to be forced to incline by the spring (42). With reference to FIGS. 5 and 6, the angle of inclination of the check plate (41) is contrary to the shifting plate (32). By means of the engagement of the rhombic angle of the front lower edge and the rear upper edge of the circular hole (411) with the gun barrel (20), the gun barrel is restrained from moving ahead. If the gun barrel (20) is released and to permit the gun barrel (20) to be moved forward, an individual would pull the lower end of the check plate (41) backward to the released position, i.e. to the dotted line position as shown in FIG. 7, to permit the check plate (41) to be in a vertical position against the gun barrel (20). Therefore, the gun barrel (20) will be able to slide through the circular hole (411).

Figure 1:
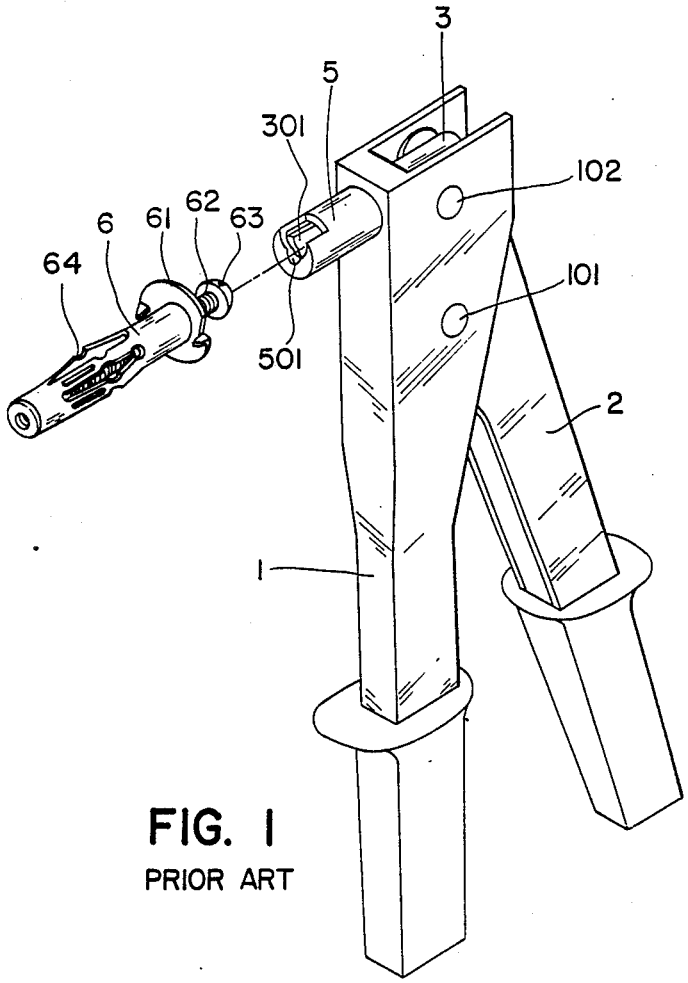
FIG. 1 PRIOR ART
FIG. 1 is a perspective view illustrating the prior art.
Figure 2:
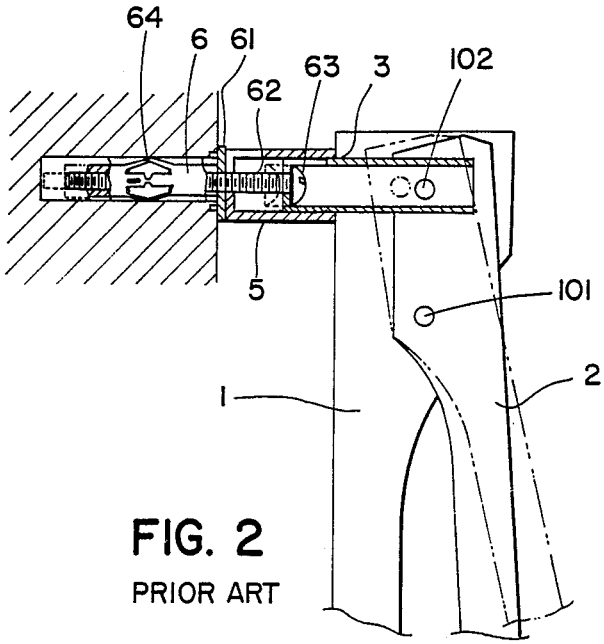
FIG. 2 PRIOR ART
FIG. 2 is a side view illustrating a partially sectional view of the prior art.

The trip plate (50) arranged to slide in the sliding seat (11) includes a notch (51) at the front for the head (63) of the live spindle (62) of the expansion bolt (6) to hang thereup and to be retained thereabout (referring to FIG. 1). A circular hole (52) is arranged at the rear wall of the trip plate (50) for a bolt (21) to thread therethrough, so as to screw up the trip plate (50) with the gun barrel (20) through the bolt hole (22). The return spring (60) and is mounted on the gun barrel (20) is positioned in the first slot (12) between the trip plate (50) and the partititon (16) to provide the trip plate (50) and the connected gun barrel (20) with a forwarding force. As shown in FIG. 7, when the operator triggers the check plate (41) to the releasing position, the trip plate (50) and the gun barrel (20) will be forced by the return spring (60) to move from the full line position to the dotted line position.

the stop block (70) is arranged to provide an upside down U-shaped configuration comprises a notch (71) at the front to permit an expansion bolt (6) to hang thereover and to stop the protruding portion (61) of the expansion bolt (6). Two circular holes (72) (73) are respectively arranged at both of the lateral side walls of the stop block (70) for bolts (81) (82) to be respectively insert therethrough to further screwed by means of the bolt holes (112) (113) of the gun holder (10), so as to fixedly attach the stop block (70) to the gun holder (10) at the front position.

In the expansion bolt extracting gun as above-described, it is to extract the gun barrel (20) backward by pressing down the movable handle (31) through a stepping operation, so as to stretch the expansion bolt positioned at the notch (51) of the trip plate (50). The check plate (41) may be triggered to move to a releasing position to permit the trip plate (50) and the gun barrel (20) to return to the original front position. By means of this arrangement, a labor-saving operation is thus achieved. According to the present invention, the sleeve (317) of the movable handle (31) is arranged to provide a protruding portion (318) to limit a hand holding position, so as to prevent the fingers from erroneously triggering the check plate (41) and to protect the operation.

As indicated, the structure herein may be variously embodied. Recognizing various modifications will be apparent, the scope hereof shall be deemed to be defined by the claims as set forth below.

I claim:

1. A stepping type expansion bolt extracting gun, comprising:

a gun holder, comprised of a sliding seat, first slot, second slot, and thrid slot respectively arranged from the front, and a fixed handle extended downward from the rear end of the gun holder, said sliding seat having a notch at the front, a partition being arranged between the first slot and the second slot, another partition being arranged between the second slot and the third slot, said two partitions and the back slide surrounding wall of the gun holder being arranged to provide a respective circular hole to aim at one another;

a cylindrical gun barrel slidable through the circular holes of said partitions and the back side surrounding wall;

a shifting mechanism, comprised of a movable handle, a shifting plate, a spring, and a locating pin, said movable handle having a forked top end fixed in the third slot by pivotal joint with the lower end flexibly arranged to move toward said fixed handle, said shifting plate being arranged to provide a flat plate-shaped configuration and positioned in the third slot with the lower portion being in contact with said movable handle, having a circular hole at the center for penetration of said gun barrel therethrough, as the movable handle is forced to move toward the fixed handle the lower portion of the shifting plate is forced to incline so as to permit the rhombic angle of the front upper edge and the rear lower edge of the circular hole of the shifting plate to engage the gun barrel to move backward, said spring being mounted on the gun barrel by a slip joint, and arranged in the third slot between the shifting plate and the back side surrounding wall to provide the shifting plate with a forward push and to permit the movable handle to return to an original position, said locating pin being positioned in the third slot of the gun holder to prohibit the upper portion of the shifting plate from moving forward and to permit the shifting plate to be arranged at vertical position against the gun barrel when it is released from the control of the movable handle, so as to permit the gun barrel to freely slide through the circular hole of the shifting plate;

an arresting and releasing mechanism comprised of a check plate, a spring, and a locating pin, said check plate being allocated in the second slot and arranged to have a prolonged configuration comprising a circular hole for penetration of the gun barrel therethrough, with the lower portion of the check plate extending downwardly to protrude beyond the gun holder to a position at the front side of the movable handle, said spring being mounted on the gun barrel and positioned in the second slot at the back side of the check plate to provide the check plate with a forward force, said locating pin being transversely allocated in the second slot and arranged at the front of the check plate to permit the check plate to be forced to incline outward, by means of the engagement of the rhombic angle of the front lower edge and the rear upper edge of the circular hole with the gun barrel, the gun barrel being restrained from moving ahead, at the time to release the gun barrel and to let the gun barrel be moved forward, the lower end of the check plate being pulled backward to the released position to permit the check plate to be in a vertical position against the gun barrel, the gun barrel being released to slide through the circular hole of the check plate;

a trip plate being arranged to slide in the sliding seat comprising a notch at the front for the head of the live spindle of the expansion bolt to hang thereup and to be retained thereabout, the rear end of the trip plate being fixedly attached to the front end of the gun barrel to follow the gun barrel to slide in the sliding seat;

a return spring is mounted on the gun barrel and positioned in the first slot between the trip plate and the partition to provide the trip plate and the connected gun barrel with a forwarding force at the time the check plate is moved to the releasing position; and a stop block being fixedly arranged at the front of the sliding seat, comprising a notch at the front to stop the rear end protruding portion of the expansion bolt;

the component parts form the expansion bolt extracting gun, including the shifting mechanism for extracting the live spindle of the expansion bolt through a stepping operation, and by means of the arresting and releasing mechanism to permit the gun barrel and the trip plate to automatically return to the original position.

2. A stepping type hook bolt expansion bolt extracting gun as claimed in claim 1 wherein the movable handle of the shifting mechanism is arranged to provide an axle pin at the top to permit the movable handle to smoothly trigger the lower portion of the shifting plate.

3. A stepping type expansion bolt extracting gun as claimed in claim 1, wherein the sleeve of the movable handle is arranged to provide a protruding portion to limit the holding position of the fingers so as to prevent the fingers from erroneously triggering the check plate and to protect the operation.

* * * * *